US008628176B2

(12) United States Patent
Lecheheb et al.

(10) Patent No.: US 8,628,176 B2
(45) Date of Patent: Jan. 14, 2014

(54) ELECTROMECHANICAL CONVERTER FOR INK JET PRINTING

(75) Inventors: Ammar Lecheheb, Cambridge (GB); Robert Smith, Cambridge (GB); Matthew Tomlin, Cambridge (GB); Peter Kassner, Algarve (PT); Michael Jeffrey Stamp, Leicester (GB)

(73) Assignee: Videojet Technologies Inc., Wood Dale, IL (US)

( * ) Notice: Subject to any disclaimer, the term of this patent is extended or adjusted under 35 U.S.C. 154(b) by 280 days.

(21) Appl. No.: 12/740,719

(22) PCT Filed: Nov. 6, 2008

(86) PCT No.: PCT/US2008/082605

§ 371 (c)(1),
(2), (4) Date: Apr. 30, 2010

(87) PCT Pub. No.: WO2009/061899

PCT Pub. Date: May 14, 2009

(65) Prior Publication Data

US 2010/0238212 A1 Sep. 23, 2010

(30) Foreign Application Priority Data

Nov. 10, 2007 (GB) ..... 0722096.5
Nov. 10, 2007 (GB) ..... 0722099.9
Nov. 10, 2007 (GB) ..... 0722101.3

(51) Int. Cl.
*B41J 2/085* (2006.01)

(52) U.S. Cl.
USPC ..... 347/76; 347/77; 347/9

(58) Field of Classification Search
USPC ..... 347/5, 9, 68, 73, 74, 76, 77
See application file for complete search history.

(56) References Cited

U.S. PATENT DOCUMENTS

| | | | |
|---|---|---|---|
| 3,868,698 | A | 2/1975 | Dressler |
| 5,196,860 | A | 3/1993 | Pickell |
| 5,455,606 | A | 10/1995 | Keeling |
| 5,465,109 | A | 11/1995 | Bowers |
| 5,754,204 | A | 5/1998 | Kitahara |
| 6,276,774 | B1 | 8/2001 | Moghadam |
| 7,364,285 | B2 | 4/2008 | Murad |
| 7,393,085 | B2 | 7/2008 | Lecheheb |

FOREIGN PATENT DOCUMENTS

| | | |
|---|---|---|
| JP | 58208063 | 12/1983 |
| WO | 9013431 | 11/1990 |

OTHER PUBLICATIONS

UK Intellectual Property Office, Search Report under Section 17 of priority application GB0722096.5, Mar. 25, 2008.

*Primary Examiner* — Lam S Nguyen
(74) *Attorney, Agent, or Firm* — Joseph A. Yosick

(57) ABSTRACT

A method of driving an electromechanical converter of a print head of a continuous inkjet printer, wherein the electromechanical converter is arranged to break up a continuous stream of ink into a plurality of drops. The method includes determining a modulation voltage to drive the electromechanical converter, at least a property of the modulation voltage being controlled to take into account movement of a break up point of the continuous stream of ink, and to ensure that in a characteristic of modulation voltage versus a property at least indicative of a break up point of the continuous stream of ink, the characteristic has a predetermined gradient, or a gradient related to this predetermined gradient; and driving the electromechanical converter at the determined modulation voltage.

20 Claims, 10 Drawing Sheets

ELECTROMECHANICAL CONVERTER FOR INK JET PRINTING

RELATED APPLICATIONS

This application claims priority under 35 U.S.C. §371 from PCT Application No. PCT/US2008/082605, filed in English on Nov. 6, 2008, which claims the benefit of: Great Britain Application Serial No. 0722096.5 filed on Nov. 10, 2007, Great Britain Application Serial No. 0722099.9 filed on Nov. 10, 2007, and Great Britain Application Serial No. 0722101.3 filed on Nov. 10, 2007, the disclosures of all of which are incorporated by reference herein in their entireties.

The present invention relates to continuous ink jet printing and more particularly to a method for driving an electromechanical converter of a print head of a continuous inkjet printer, and an apparatus for undertaking this method.

BACKGROUND

In ink jet printing systems the print is made up of individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurised ink to a print head drop generator where a continuous stream of ink emanating from a nozzle is broken up into individual regular drops by, for example, an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. The charged drops bypass the gutter and hit the substrate at a position determined by the charge on the drop and the position of the substrate relative to the print head. Typically the substrate is moved relative to the print head in one direction and the drops are deflected in a direction generally perpendicular thereto, although the deflection plates may be oriented at an inclination to the perpendicular to compensate for the speed of the substrate (the movement of the substrate relative to the print head between drops arriving means that a line of drops would otherwise not quite extend perpendicularly to the direction of movement of the substrate).

In continuous ink jet printing a character is printed from a matrix comprising a regular array of potential drop positions. Each matrix comprises a plurality of columns (strokes), each being defined by a line comprising a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

Ink is delivered under pressure to the print head by an ink supply system that is generally housed within a sealed compartment of a cabinet that includes a separate compartment for control circuitry and a user interface panel. The ink may be mixed with a solvent, for example to assist in the control of the viscosity of the ink-solvent mixture.

As mentioned above, a continuous stream of ink is broken up into individual regular drops by, for example, an oscillating piezoelectric element. The number of drops generated per second is proportional to the oscillation frequency of the piezoelectric element. The piezoelectric element is typically driven at or near to its resonant frequency. The resonant frequency is controlled (in other words, tuned) to ensure that it is equal to or near a predetermined driving frequency, the predetermined driving frequency being chosen to ensure that a specific number of drops are generated per second. The mass of the piezoelectric element may be increased or decreased to alter its resonant frequency.

Controlling the resonant frequency of the piezoelectric element by changing its mass is a skilled and time consuming task, usually undertaken by skilled technicians. It is therefore usual for the entire print head to be replaced with a new print head having a correctly tuned piezoelectric element, or for the entire print head to be sent away (e.g. to the manufacturer of the print head or piezoelectric element) to have a newly tuned piezoelectric element installed. This is costly, and may also result in the printer being inoperable for a period of time. The replacement and/or reinstallation may need to be undertaken periodically, for example to take into account changes in environmental conditions, due to, for example, relocation of the printer or print head.

The distance from the nozzle at which the continuous stream of ink breaks up into individual regular drops (i.e. the break up point) is dependent upon many factors. One factor which has an effect on the location of the break up point is the magnitude of the oscillations of the oscillating piezoelectric element. The magnitude of the oscillations of the piezoelectric element are proportional to the magnitude of the modulating voltage which drives the oscillating piezoelectric element. By increasing or decreasing the magnitude of the modulation voltage, the break up point can be moved relative to the nozzle from which the continuous stream of ink emanates. However, the relationship between modulation voltage and the distance from the nozzle at which break up occurs (often referred to as the break up length) is not always a directly proportional relationship.

In many cases, an increase in the magnitude of the modulation voltage will result in a decrease in the break up length up to a certain point, after which further increases in the modulation voltage will result in a decrease of the break up length. The point at which the break up length stops decreasing (or increasing) and begins to increase (or decrease) is often referred to as a turning point. Selection of the magnitude of the modulation voltage to ensure that break up of the continuous stream into individual droplets occurs around this turning point is advantageous. In the region around the turning point, the formation of satellite drops is reduced or eliminated. Satellite drops are much smaller and often more irregularly shaped drops which accompany the regular drops breaking out of the continuous stream. Such satellite drops can lead to a reduction in print quality, and it is therefore desirable to reduce or eliminate them. It is often preferred to choose a modulation voltage which does not result in a break up length which coincides with the turning point. This is because a break up length which coincides with the turning point may be unstable. In previous continuous ink jet printers, it is therefore known to first identify a turning point, and to then choose a modulation voltage which results in a break up length which is slightly offset from the turning point.

The exact position of the turning point is dependent on a number of factors, for example the ink and solvent used, the temperature of the ink-solvent mix, and the viscosity of the ink-solvent mix. In some cases, a turning point may not be detected in the operating modulation voltage range of the oscillating piezoelectric element. Even for ink-solvent mixtures which do normally exhibit a turning point in the range of operating modulating voltages, the turning point may not be detected due to changes in conditions of, for example, the ink-solvent mixture. If a turning point cannot be identified, the known method of identifying a turning point and choosing a modulation voltage which results in a break up length slightly offset from the turning point is not workable.

In the prior art, a turning point is identified, and then a modulation voltage is chosen which results in a break up length slightly offset from the turning point. This chosen modulation voltage is then applied to the oscillating piezoelectric element. This modulation voltage will be applied to the oscillating piezoelectric element continuously while the machine is running. In other words, the modulation voltage will not be changed. If the break up point of the continuous stream of ink moves (or, more generally, the break up point-modulation voltage characteristic changes) the applied modulation voltage may no longer result in an acceptable print quality. For example, if the break up point-modulation voltage characteristic changes, for example, due to changes in temperature, the previously calculated modulation voltage may coincide with a point on the characteristic which is no longer sufficiently near a turning point to achieve little or no satellite drop generation. The characteristic may change so much that, at the applied modulation voltage, the break up point of the continuous stream of ink is no longer within or in the vicinity of the charge electrode. This may mean that drops emerging from the continuous stream of ink may not be charged as required, or charged at all, again having a detrimental effect on print quality.

BRIEF SUMMARY OF THE INVENTION

It is one object of the present invention, amongst others, to provide for an improved or an alternative method of driving an electromechanical converter of a print head of a continuous inkjet printer, or an arrangement for undertaking this method.

According to a first aspect of the present invention there is provided a method of driving an electromechanical converter of a print head of a continuous inkjet printer, the electromechanical converter being arranged to break up a continuous stream of ink into a plurality of drops, the method comprising: determining a modulation voltage to drive the electromechanical converter, at least a property of the modulation voltage being controlled to take into account movement of a break up point of the continuous stream of ink, and to ensure that in a characteristic of modulation voltage versus a property at least indicative of a break up point of the continuous stream of ink, the characteristic has a predetermined gradient, or a gradient related to this predetermined gradient; and driving the electromechanical converter at the determined modulation voltage The determining of the modulation voltage and the driving of the electromechanical converter may be undertaken simultaneously (e.g. a modulation voltage which is used to drive the electromechanical converter maybe varied until the modulation voltage is as determined).

The predetermined gradient, or a gradient related to this predetermined gradient, is predetermined in so far as that the driving of the electromechnical converter takes into account the predetermined gradient, or a gradient related to this predetermined gradient. For instance, the predetermined gradient, or a gradient related to this predetermined gradient may have been determined many months ago, many days ago, an hour or so ago, or a fraction of a second or less before the electromechanical converter is driven at a modulation voltage to achieve the predetermined gradient, or a gradient related to this predetermined gradient. The predetermined gradient, or a gradient related to this predetermined gradient, may have been predetermined so recently with respect to the driving of the electromechanical converter to achieve the gradient in the characteristic as to be almost simultaneous in time with the driving of the electromechanical converter to achieve the gradient in the characteristic.

It will be understood that in the context of this invention, the term 'pre-determined' is synonymous with the term 'pre-selected', and that the two terms may be used interchangeably. For example, a predetermined gradient will be a pre-selected gradient (e.g. a desired gradient for a desired property of the ink, ink drops, break-up length etc.), in that a gradient will be selected beforehand. This means that the method will ensure that in a characteristic of modulation voltage versus a property at least indicative of a break up point of the continuous stream of ink, the characteristic has a pre-selected gradient, or a gradient related to this pre-selected gradient.

The term 'take into account movement of a break up point of the continuous stream of ink' may encompass the controlling of a property of the modulation voltage with which the electromechanical converter is driven in response to movement of the break up point. The term may also be interpreted more broadly, and is not limited to responding to movement of the break up point. For example, movement of the break up point may be foreseeable (due to, for example, prior knowledge of the behaviour or the break up point in different situations and under different conditions). This means that the property of the modulation voltage can be changed as the break up point moves, or even before it moves. Information regarding movement of the break up point may be stored in a data store, such as a look up table or the like.

The property of the modulation voltage may be the magnitude of the modulation voltage. The property of the modulation voltage may be the frequency of the modulation voltage.

When a modulation voltage which is sufficient to ensure that the characteristic has the predetermined gradient cannot be used, the method may comprise changing the frequency of the modulation voltage so that a modulation voltage can be used which results in a gradient on the characteristic which is equal to the predetermined gradient. When a modulation voltage which is sufficient to ensure that the characteristic has the predetermined gradient is outside of an operating voltage range, the method may comprise changing the frequency of the modulation voltage so that a modulation voltage can be used which is within the operating voltage range, and which results in a gradient on the characteristic which is equal to the predetermined gradient. The operating voltage range may be an operating voltage range of the electromechanical converter.

If the property of the modulation voltage cannot be controlled to ensure that, in the characteristic of modulation voltage versus the property at least indicative of the break up point of the continuous stream of ink, the characteristic has the predetermined gradient, the method may comprise controlling the property of the modulation voltage to ensure that in the characteristic of modulation voltage versus the property at least indicative of the break up point of the continuous stream of ink, the characteristic has a gradient related to the predetermined gradient. The related gradient may be the closest gradient in magnitude to the predetermined gradient. For example, in some situations a modulation voltage cannot be used because it is too large or too small in magnitude or frequency to be generated by a driving arrangement, or because it is outside of an operating range of a part of the apparatus which undertakes the method.

The method may comprise using an already obtained characteristic to determine the property of the modulation voltage, and/or a magnitude of the property of the modulation voltage.

The method may comprise determining at least a part of the characteristic in order to determine the property of the modulation voltage, and/or a magnitude of the property of the modulation voltage.

The property at least indicative of the break up point of the continuous stream of ink may be one of a group comprising: a break up point; a break up length; a break up time; and a phase angle between a break up point and a signal used to give drops of ink a charge.

The method may comprise: determining a gradient of the (determined or received) characteristic at a modulation voltage with which the electromechanical converter is driven; comparing the magnitude of the determined gradient with the magnitude of the predetermined gradient, or the gradient related to the predetermined gradient; and controlling a property of the modulation voltage to bring the magnitude of the determined gradient closer to the magnitude of the predetermined gradient, or the gradient related to the predetermined gradient. This process may be undertaken one or more times, and may be iterative.

The method may be undertaken by an arrangement comprising: a driving arrangement configured to drive the electromechanical converter at the determined modulation voltage.

The method may comprise providing the arrangement with information at least indicative of the predetermined gradient.

The method may comprise providing the arrangement with information at least indicative of the characteristic.

The method may comprise the arrangement determining at least a part of the characteristic.

The method may be undertaken automatically

The predetermined gradient, or a gradient related to this predetermined gradient, may be at least indicative of properties of the ink which forms the continuous stream of ink.

The predetermined gradient, or a gradient related to this predetermined gradient, may be non-zero.

According to a second aspect of the present invention there is provided an apparatus comprising an arrangement which is configured to drive an electromechanical converter of a print head of a continuous inkjet printer, the electromechanical converter being arranged to break up a continuous stream of ink into a plurality of drops, the arrangement comprising:

a driving arrangement configured to drive the electromechanical converter with a modulation voltage, and configured to control at least a property of the modulation voltage to take into account movement of a break up point of the continuous stream of ink, and to ensure that in a characteristic of modulation voltage versus a property at least indicative of a break up point of the continuous stream of ink, the characteristic has a predetermined gradient, or a gradient related to this predetermined gradient.

The arrangement may be configured to control the magnitude of the modulation voltage.

The arrangement may be configured to control the frequency of the modulation voltage.

The arrangement may be configured to receive information at least indicative of the predetermined gradient.

The arrangement may be configured to receive information at least indicative of the characteristic.

The arrangement may be configured to determine at least a part of the characteristic.

The arrangement may be configured to determine the property of the modulation voltage, and/or a magnitude of the property of the modulation voltage. The arrangement may be configured to determine the property of the modulation voltage, and/or a magnitude of the property of the modulation voltage, from a determined characteristic. The arrangement may be configured to determine the property of the modulation voltage, and/or a magnitude of the property of the modulation voltage, from a received characteristic.

The apparatus may comprise a data storage medium, the data storage medium being configured to store information at least indicative of the predetermined gradient, the gradient related to the predetermined gradient, or the characteristic. The arrangement may be configured to receive information from the data storage medium.

The electromechanical converter may be a piezoelectric oscillator.

The apparatus may be, or may comprise, a print head of a continuous inkjet printer.

The apparatus may be, or may comprise, a continuous inkjet printer.

According to a third aspect of the present invention there is provided a method of driving an electromechanical converter of a print head of a continuous inkjet printer, the electromechanical converter being arranged to break up a continuous stream of ink into a plurality of drops, the method comprising: determining a modulation voltage which is sufficient in magnitude to ensure that in a characteristic of modulation voltage versus a property at least indicative of a break up point of the continuous stream of ink, the characteristic has a predetermined gradient, or a gradient related to this predetermined gradient, and driving the electromechanical converter with the determined modulation voltage.

The determining of the modulation voltage and the driving of the electromechanical converter may be undertaken simultaneously (e.g. a modulation voltage which is used to drive the electromechanical converter maybe varied until the modulation voltage is as determined).

The predetermined gradient, or a gradient related to this predetermined gradient, is predetermined in so far as that the driving of the electromechanical converter takes into account the predetermined gradient, or a gradient related to this predetermined gradient. For instance, the predetermined gradient, or a gradient related to this predetermined gradient may have been determined many months ago, many days ago, an hour or so ago, or a fraction of a second or less before the electromechanical converter is driven at a modulation voltage to achieve the predetermined gradient, or a gradient related to this predetermined gradient. The predetermined gradient, or a gradient related to this predetermined gradient, may have been predetermined so recently with respect to the driving of the electromechanical converter to achieve the gradient in the characteristic as to be almost simultaneous in time with the driving of the electromechanical converter to achieve the gradient in the characteristic.

The method may comprise using an already obtained characteristic to determine the modulation voltage that is sufficient in magnitude to achieve the pre-determined or related gradient in the characteristic. The method may comprise determining at least a part of the characteristic in order to determine the modulation voltage that is sufficient in magnitude to achieve the pre-determined or related gradient in the characteristic. The method may comprise varying the modulation voltage and measuring the property at least indicative of the break up point of the continuous stream of ink to determine at least a part of the characteristic.

The property at least indicative of the break up point of the continuous stream of ink may be one of a group comprising: a break up point; a break up length; a break up time; and a phase angle between a break up point and a signal used to give drops of ink a charge.

When a modulation voltage cannot be used which is sufficient to ensure that the characteristic has the predetermined gradient, the method may comprise driving the electromechanical converter at a modulation voltage which results in a gradient on the characteristic which is related to this predetermined gradient. For example, in some situations a modulation voltage cannot be used because it is too large or too small to be generated by a driving arrangement, or because it is outside of an operating range of a part of the apparatus which undertakes the method. When the modulation voltage that is sufficient in magnitude to achieve the pre-determined or related gradient in the characteristic is outside of an operating voltage range, the method may comprise driving the electromechanical converter at a modulation voltage which results in a gradient on the characteristic which is related to this predetermined gradient. The operating voltage range may be an operating voltage range of the electromechanical converter. The related gradient may be the closest gradient in magnitude to the predetermined gradient.

The method may be undertaken by an arrangement comprising: a driving arrangement configured to drive the electromechanical converter with a modulation voltage which is sufficient in magnitude to achieve the pre-determined or related gradient in the characteristic The method may comprise providing the arrangement with information at least indicative of the predetermined gradient. The method may comprise providing the arrangement with information at least indicative of the characteristic.

The method may comprise the arrangement determining at least a part of the characteristic.

The method may be undertaken automatically

The predetermined gradient, or a gradient related to this predetermined gradient, is at least indicative of properties of the ink which forms the continuous stream of ink.

The predetermined gradient, or a gradient related to this predetermined gradient, may be non-zero.

According to a fourth aspect of the present invention there is provided an apparatus comprising an arrangement which is configured to drive an electromechanical converter of a print head of a continuous inkjet printer, the electromechanical converter being arranged to break up a continuous stream of ink into a plurality of drops, the arrangement comprising: a driving arrangement configured to drive the electromechanical converter with a modulation voltage, the modulation voltage being sufficient in magnitude to ensure that in a characteristic of modulation voltage versus a property at least indicative of a break up point of the continuous stream of ink, the characteristic has a predetermined gradient, or a gradient related to this predetermined gradient.

The arrangement may be configured to receive information at least indicative of the predetermined gradient. The arrangement may be configured to receive information at least indicative of the characteristic.

The arrangement may be configured to determine at least a part of the characteristic. The arrangement may be configured to determine the modulation voltage that is sufficient in magnitude to achieve the pre-determined or related gradient in the characteristic. The arrangement may be configured to determine the modulation voltage that is sufficient in magnitude to achieve the pre-determined or related gradient in the characteristic from a determined characteristic. The arrangement may be configured to determine the modulation voltage that is sufficient in magnitude to achieve the pre-determined or related gradient in the characteristic from a received characteristic.

The arrangement may further comprise a data storage medium, the data storage medium being configured to store information at least indicative of the predetermined gradient, the gradient related to the predetermined gradient, or the characteristic. The arrangement may be configured to receive information from the data storage medium.

The electromechanical converter may be a piezoelectric oscillator.

The apparatus may be, or may comprise, a print head of a continuous inkjet printer.

The apparatus may be, or may comprise, a continuous inkjet printer.

According to another aspect of the present invention there is provided a method of driving an electromechanical converter of a print head of a continuous inkjet printer, the electromechanical converter being arranged to break up a continuous stream of ink into a plurality of drops, the method comprising: determining a resonant frequency of the electromechanical converter; selecting a frequency from a plurality of frequencies at which to drive the electromechanical converter based upon the determined resonant frequency; and driving the electromechanical converter at the selected frequency.

The selected frequency may be equal to or relative to the resonant frequency.

The method may be undertaken on more than one occasion. The method may be undertaken periodically. May be, the method may be undertaken each time the continuous inkjet printer is turned on.

The method may be undertaken automatically.

If, on an undertaking of the method the resonant frequency cannot be determined, the method may comprise driving the electromechanical converter at a previously determined resonant frequency.

Determining a resonant frequency of the electromechanical converter may comprise applying a modulation voltage having a first frequency to the electromechanical converter and varying the frequency at which the modulation voltage is applied, and determining the resonant frequency by observing the response of the electromechanical converter to the variation in the frequency of the applied modulation voltage.

The resonant frequency may be determined by observing an increase in impedance of the electromechanical converter (e.g. electrical impedance or resistance, or mechanical resistance). The resonant frequency may be determined by observing a decrease in current flow through the electromechanical converter. The resonant frequency may be determined by observing an increase in an amplitude of movement of the electromechanical converter.

The method may be undertaken by an arrangement comprising: a determination arrangement for determining the resonant frequency of the electromechanical converter; and a driving arrangement configured to drive the electromechanical converter at a frequency equal to or relative to the determined resonant frequency.

According to another aspect of the present invention there is provided an apparatus comprising an arrangement which is configured to drive an electromechanical converter of a print head of a continuous inkjet printer, the electromechanical converter being arranged to break up a continuous stream of ink into a plurality of drops, the arrangement comprising: a determination arrangement for determining a resonant frequency of the electromechanical converter; and a driving arrangement configured to drive the electromechanical converter at a frequency equal to or relative to the determined resonant frequency Embodiments will now be described, by way of example only, with reference to the accompanying Figures:

BRIEF DESCRIPTION OF THE DRAWINGS

It should be noted that the Figures are not drawn to scale, and in some cases are deliberately not drawn to scale in order to more clearly identify specific features. Like features appearing in different Figures have been given the same reference numerals.

DETAILED DESCRIPTION

Figure 1:
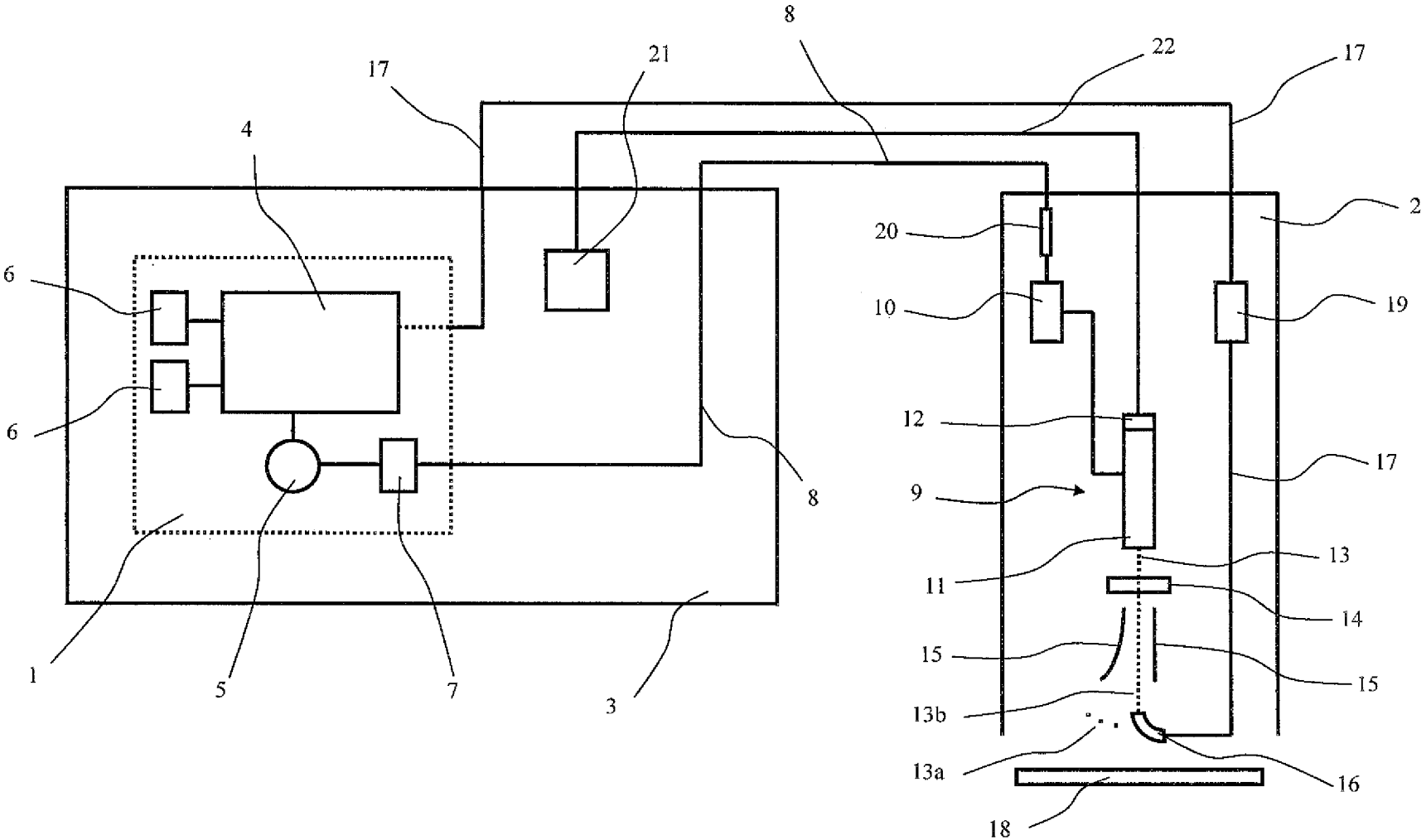
FIG. 1 is a schematic depiction of a continuous inkjet printer.

Referring now to FIG. 1 of the drawings, an ink-solvent mixture is delivered under pressure from an ink supply system 1 to a print head 2. The ink supply system 1 is located in a cabinet 3 which is typically table mounted and the print head 2 is disposed outside of the cabinet 3. A detailed description of the operation of the ink supply system 1 is not required here, since it is not of significant relevance to the present invention. It is sufficient to say that, in operation, ink is drawn from a reservoir of ink in a mixer tank 4 by a system pump 5. The tank 4 is topped up as necessary with ink and make-up solvent from ink and solvent cartridges 6. Ink drawn from the main tank 4 is passed through at least one filter 7 before it is delivered to an ink feed line 8 to the print head 2.

At the print head 1 the ink from the feed line 8 is supplied to a drop generator 9 via a first flow control valve 10. The drop generator 9 comprises a nozzle 11, from which the pressurised ink is discharged, and a piezoelectric oscillator 12. The piezoelectric oscillator 12 creates pressure perturbations in the ink flow (i.e. a volume of ink) at a predetermined frequency and amplitude so as break up the ink flow into drops 13 of a regular size and spacing. The break up point is downstream of the nozzle 11 and coincides with a charge electrode 14 where a predetermined charge is applied to selected drops 13*a*. This charge determines the degree of deflection of the charged drops 13*a* as they pass a pair of deflection plates 15 between which a substantially constant electric field is maintained. Uncharged drops 13*b* pass substantially undeflected to a gutter 16 from where they are recycled to the ink supply system 1 (and, for example, to the mixer tank 4) located in the cabinet 3 via a return line 17. Charged (and therefore deflected) drops 13*a* are projected towards a substrate 18 (for example, a plastic sheet) that moves past the print head 2. The position at which each deflected drop 13*a* impinges on the substrate 18 is determined by the amount of deflection of the drop 13*a* and the speed of movement of the substrate 18. For instance, if the substrate 18 moves in a horizontal direction, perpendicular to the direction of deflection of the drop 13*a*, the deflection of the drop 13*a* determines its vertical position in the stroke of the character matrix.

In instances where the printer is started up from rest it is desirable to allow ink to bleed through the nozzle 11 without being projected toward the gutter 16 or the substrate 18. The passage of the ink into the return line 17, whether it is the bleed flow or recycled unused ink captured by the gutter 16, is controlled by a second flow control valve 19. The returning ink is drawn back to the mixer tank 4 by a pump arrangement, for example the system pump 5.

In order to ensure effective operation of the drop generator 9 the temperature of the ink entering the print head 2 may be maintained at a desired level by a heater 20 before the ink passes to the first control valve 10.

The piezoelectric oscillator 12 is connected to an arrangement 21 by an electrical connection 22 (for example, a wire). The arrangement 21 is configured to drive the piezoelectric oscillator 12 by providing it with an electrical signal of a specific frequency and amplitude. The driving frequency is such that the piezoelectric oscillator 12 oscillates at or near to its resonant frequency. This is so that a large amount of oscillation can be more easily achieved. In prior art continuous inkjet printers, the driving frequency is predetermined to achieve a certain number of drops per second, and the piezoelectric oscillator 12 is tuned such that its resonant frequency is equal to or near to this predetermined frequency. This tuning process is described in more detail in relation to FIGS. 2*a* to 2*c*, and in FIG. 3.

Figure 2A:
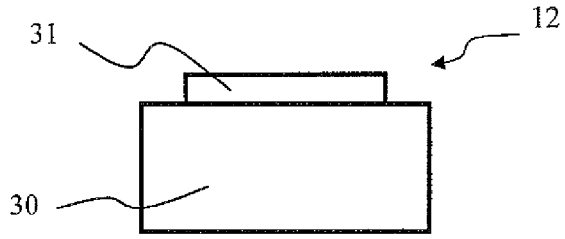
FIGS. 2*a* to 2*c* schematically depict a prior art tuning process undertaken on a piezoelectric oscillator.
Figure 3:
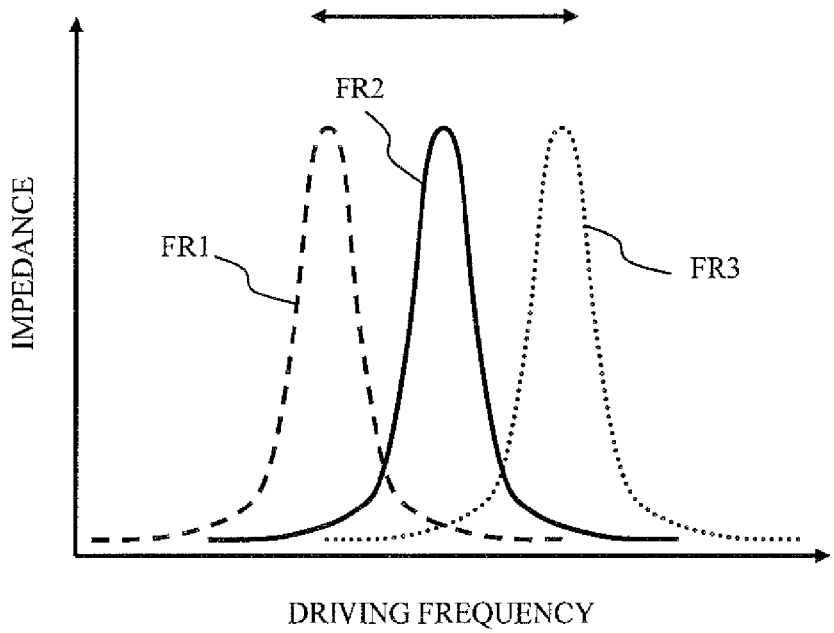
FIG. 3 is a graph schematically depicting the changes in the resonant frequency of a piezoelectric oscillator resulting from the tuning process depicted in FIGS. 2*a* to 2*c;*

FIG. 2*a* schematically depicts a piezoelectric oscillator 12. The piezoelectric oscillator 12 comprises a piezoelectric element 30 and a load mass 31. The load mass 31 may comprise solder or any other material which can be attached to the piezoelectric element 30. The resonant frequency of the piezoelectric oscillator 12 shown in FIG. 2*a* can be determined by applying a voltage across the piezoelectric element 30. For example, a voltage of 100V may be applied across the piezoelectric element 30. The frequency at which this voltage is applied to the piezoelectric element 30 (e.g. in the form of a square wave) can be swept across a range of values. At a specific frequency, the impedance (that is, the electrical resistance) of the piezoelectric element 30 will increase. In practical terms, at this frequency the magnitude of the oscillations of the piezoelectric element 30 will increase. At this stage, the piezoelectric element 30 has been driven at or near to its resonant frequency. FIG. 3 shows the situation when the resonant frequency has been reached, where the impedance rises sharply.

In a prior art continuous inkjet printer, the printer is configured to drive the piezoelectric element 30 at a specific predetermined frequency. For example, it may be desirable to drive the piezoelectric element 30 at 76.8 kHz. This ensures that a specific, predetermined number of drops are generated, in this example 76,800 drops per second. As mentioned above, it is desirable that the piezoelectric element 30 is driven at or near to its resonant frequency. Referring back to FIG. 1, when the piezoelectric oscillator 12 is first installed (or replaced, etc.), its exact resonant frequency will not yet be known in the environment in which it is going to be used. Therefore, it will be necessary to tune the piezoelectric oscillator 12 such that its resonant frequency is at or sufficiently near to the predetermined driving frequency of the continuous inkjet printer.

Figure 2B:
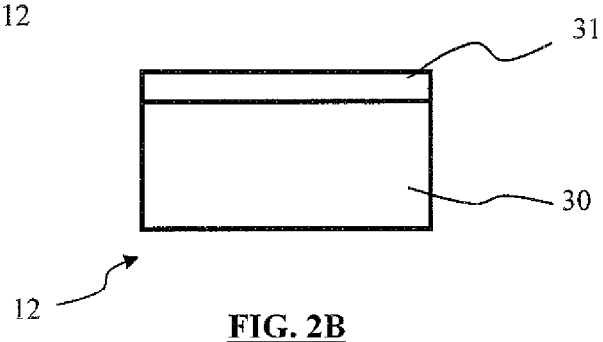
Figure 2C:
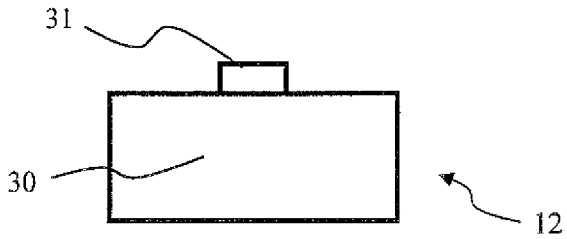

The tuning process involves increasing or decreasing the mass of the piezoelectric oscillator 12. Referring to FIGS. 2*a* to 2*c* again, an increase or decrease in mass can be achieved by varying the mass of the load mass 31, or by adding material to, or removing material from the load mass 31. For example, it can be seen in FIG. 2*b* that the load mass is larger than in FIG. 2*a*. Conversely, it can be seen in FIG. 2*c* that the load mass 31 is smaller than in either FIG. 2*a* or FIG. 2*b*. This change in mass will have a proportional effect on the resonant frequency of the piezoelectric oscillator 12 which comprises the piezoelectric element 30 and the load mass 31. This corresponding change in the resonant frequency is reflected in the graph shown in FIG. 3, which schematically depicts three different resonant frequencies FR1, FR2, FR3 for the three different load masses represented in FIGS. 2*a* to 2*c*.

In order to add mass to the load mass 31, additional solder (or other material) may be added to the load mass 31. Conversely, to reduce the mass of the load mass 31, solder (or other material) may be removed from the load mass 31. Each time material is added or taken away from the load mass 31, the resonant frequency of the resultant piezoelectric oscillator 12 must be determined. The mass of the load mass 31 will be continuously altered in a step-wise iterative process until the resonant frequency of the piezoelectric oscillator 12 is at or sufficiently near to the predetermined driving frequency of the continuous inkjet printer.

It will be appreciated that the tuning process requires a significant amount of skill and time to perform. The tuning process may need to be undertaken on a number of occasions, for example: the first time the continuous inkjet printer is used; when a replacement piezoelectric oscillator has been installed; when the continuous inkjet printer is used in a different environment; or simply periodically, in order to maintain efficient operation of the continuous inkjet printer. It is therefore usual for the print head to be returned to, for example, the manufacturer of the print head, so that the print head may be replaced with a print head having an appropriately tuned piezoelectric oscillator, or so that the piezoelectric oscillator of the returned print head can be replaced with an appropriately tuned piezoelectric oscillator. The return and/or replacement of the print head may be costly, and/or time consuming. For instance, whenever the print head and piezoelectric oscillator has been returned it cannot be used, which may lead to the continuous inkjet printer being inoperable. Clearly, it is desirable to avoid an increase in costs wherever possible, as well as reducing the period of time for which the continuous inkjet printer is inoperable.

Figure 4:
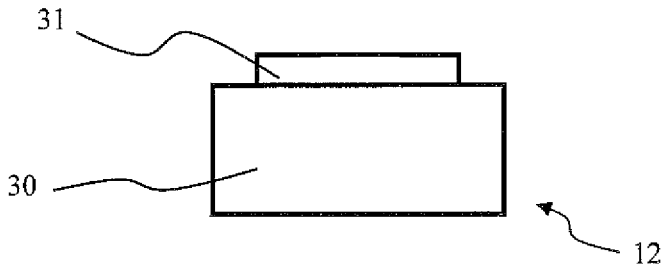
FIG. 4 schematically depicts an unmodified piezoelectric oscillator.
Figure 5:
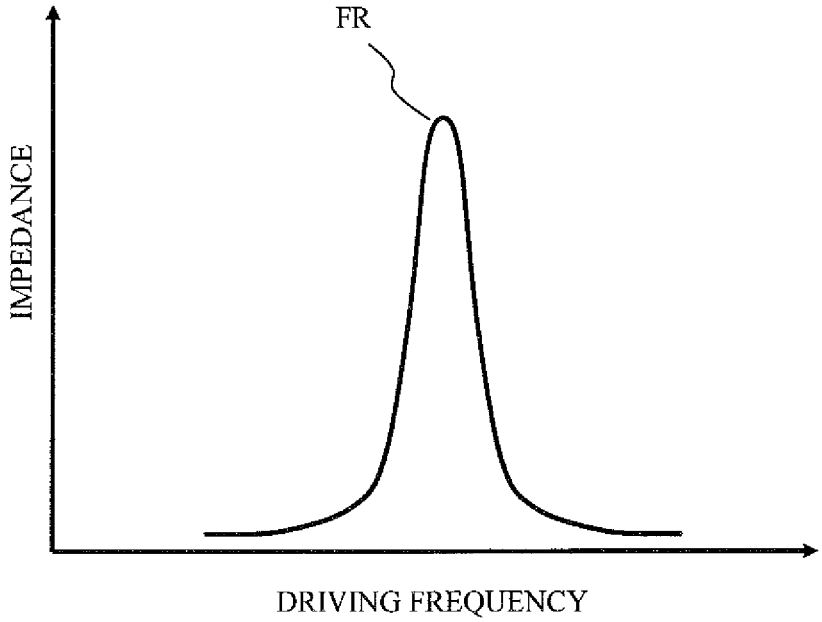
FIG. 5 is a graph schematically depicting the resonant frequency of the unmodified piezoelectric oscillator depicted in FIG. 4.

FIGS. 4 and 5 schematically depict operating principles of an embodiment. FIG. 4 schematically depicts a piezoelectric oscillator 12. As described above in relation to FIGS. 2*a* to 2*c*, the piezoelectric oscillator 12 comprises a piezoelectric element 30, to which is attached a load mass 31. FIG. 5 shows that, as expected, the piezoelectric oscillator 12 of FIG. 4 has a resonant frequency FR.

In an embodiment, in use, the piezoelectric oscillator 12 of FIG. 4 is driven at or near to its unmodified resonant frequency. That is, the arrangement 21 (see FIG. 1) is configured to drive the piezoelectric oscillator 12 by providing it with an electric signal having a frequency at or near to the unmodified resonant frequency of the piezoelectric oscillator 12. This means that, in contrast to the prior art, no tuning of the piezoelectric oscillator 12 is undertaken.

When the piezoelectric oscillator 12 is constructed and supplied to the manufacturer of the continuous inkjet printer (or print head), the resonant frequency of the piezoelectric oscillator 12 may be in the region of a predetermined resonant frequency. This predetermined resonant frequency will be close to that specified by the manufacturer or user of the continuous inkjet printer. The exact value of this resonant frequency will not be known until the piezoelectric oscillator 12 is tested in an environment in which it is going to be used, thereby taking into account temperature considerations and the like. In the prior art, a predetermined driving frequency which is to be applied to the piezoelectric oscillator 12 is chosen. The resonant frequency of the piezoelectric oscillator 12 is then determined and then tuned into this desired and predetermined driving frequency. In contrast, the present embodiment takes exactly the opposite approach. That is, it is already assumed that the resonant frequency of the supplied or manufactured piezoelectric oscillator 12 is, in general, sufficient for acceptable operation of the continuous inkjet printer. Therefore, the fabricated or supplied piezoelectric oscillator 12 is simply driven at its unmodified (that is, not tuned) resonant frequency. This avoids the costly and time consuming requirement of tuning the piezoelectric oscillator 12 every time a new one is supplied, or the time and cost of having to send the print head back to the manufacturer for an appropriately tuned piezoelectric oscillator.

It may well be that the resonant frequency of the unmodified (i.e. not tuned) piezoelectric oscillator 12 is slightly lower or higher than the predetermined driving frequencies often used in the prior art. If the resonant frequency of the piezoelectric oscillator 12 is higher, then more drops can be generated per second meaning that there will be no loss in performance. If, on the other hand, there is a slight reduction in the resonant frequency when compared to a predetermined desired frequency used in the prior art, any slight loss in the number of drops generated (for example, fractions of a percent) is insignificant in comparison with the time and costs saved in not having to have the piezoelectric oscillator 12 retuned or replaced.

Since the piezoelectric oscillator 12 does not need to be tuned or re-tuned, various advantages are forthcoming in addition to the time and cost advantages mentioned above. For example, the resonant frequency of the piezoelectric oscillator 12 may be periodically determined in-situ, and the driving frequency applied to it varied accordingly. This means that any changes in the resonant frequency can be quickly and accurately accounted for, with there being no need to remove, replace or tune or re-tune the piezoelectric oscillator 12 by changing its mass. The determination of the resonant frequency of the piezoelectric oscillator 12 may be undertaken each time the machine is started up, or even when the machine is running. The determination of the resonant frequency of the piezoelectric oscillator 12 and the corresponding change in the frequency used to drive the piezoelectric oscillator 12 may be undertaken periodically (for example, to take into account drift of the resonant frequency due to ageing), or when the piezoelectric oscillator 12 is replaced, or when the continuous inkjet printer or just the print head is moved to a new location.

The resonant frequency of the piezoelectric oscillator 12 may be readily determined by the arrangement 21, for example, by measuring the impedance of the piezoelectric oscillator 12, the current flowing through the piezoelectric oscillator 12, or the amplitude of oscillation of the piezoelectric oscillator 12 as different driving frequencies are applied to it. Such a process may be undertaken in a very short period of time, for example in a few seconds or less, and then the driving frequency applied to the piezoelectric oscillator 12 can be varied again in a few seconds using the arrangement 21. This is in contrast to the prior art method, where it could take days or more to send away a print head for the addition of a newly tuned piezoelectric oscillator, or the replacement of the entire print head.

It can therefore be seen that by taking a different approach to selecting the driving frequency applied to the piezoelectric oscillator of a print head of a continuous inkjet printer, numerous advantages can be obtained. In summary, in the prior art the piezoelectric oscillator is tuned such that its resonant frequency is at or near to a predetermined (i.e. pre-selected) driving frequency of the continuous inkjet printer. In contrast, in the present embodiment the frequency at which the piezoelectric oscillator is driven is selected from a plurality of frequencies (e.g. a sweep) to be at or near to the determined and unmodified resonant frequency of the piezoelectric oscillator.

The foregoing description refers to a piezoelectric oscillator. It will be appreciated that other devices capable of causing oscillations may also be used. That is, any device which can convert an electrical signal into a mechanical signal may be used. In other words, any electromechanical converter (in other words a transducer) may be suitable. For example, a piston or rotary arrangement may be used.

In this description, a load mass has been described as being attached to a piezoelectric element. This is not essential. For example, a piezoelectric oscillator may be fabricated or supplied which does not have a load mass attached to it, the mass of the piezoelectric element itself being sufficient to ensure that the resonant frequency is at, near to, a desired value.

If, for whatever reason, a resonant frequency of the piezoelectric oscillator cannot be determined, the driving frequency may be chosen to be a previously determined resonant frequency.

In this description, an arrangement has been described which can determine the resonant frequency of the piezoelectric oscillator, and then drive the piezoelectric oscillator at, for example, a frequency equal or relative to the resonant frequency. In other words, the arrangement comprises: a determination arrangement for determining a resonant frequency of the electromechanical converter (e.g. piezoelectric oscillator); and a driving arrangement configured to drive the electromechanical converter at a frequency equal to or offset from the determined resonant frequency. The arrangement may comprise any suitable elements to determine a resonant frequency of the electromechanical converter, and drive the electromechanical converter. Such elements may include: an oscilloscope; a signal generator; a computer; one or more programmed chips; an embedded processor. The arrangement may be part of any suitable apparatus. For example, the apparatus may be a control module, the print head, or, more generally, part of the continuous inkjet printer. For example, the arrangement may be located in the cabinet 3 of FIG. 1. The arrangement may form part of the control circuitry of the cabinet.

The method of determining the resonant frequency of the electromechanical converter, and then driving the electromechanical converter at a frequency at or relative to this determined frequency may be undertaken automatically (e.g. each time the printer is turned on, periodically, etc.). Alternatively or additionally, the method may be undertaken when a user requests it to be undertaken, for example during a maintenance routine or at any other time.

As mentioned above, drops of ink are directed past a charge electrode, where they are selectively and separately given a predetermined charge before they pass through a transverse electric field provided across a pair of deflection plates. In order to apply a predetermined charge to a droplet, the continuous stream of ink from which the drop emerges is provided with a charge by the charge electrode, and the charge continues to be provided until after the droplet has broken away from the continuous stream. The exact timing of the application of this charge is important, since the timing ensures that certain drops are given certain charges. The charges which are applied are dependent upon the charge provided by the charge electrode, which is driven by a time varying signal. The time varying signal should, at least in part, have a known phase relationship with the generation of the droplets, in order to ensure that a desired charge is applied to a desired droplet.

In order to be able to successfully apply such a specific charge to a specific drop, at the very least an approximate location of the point at which the continuous stream of ink breaks into droplets needs to be determined. This break up point needs to be within or adjacent to the charge electrode (depending on the configuration of the charge electrode).

Figure 6A:
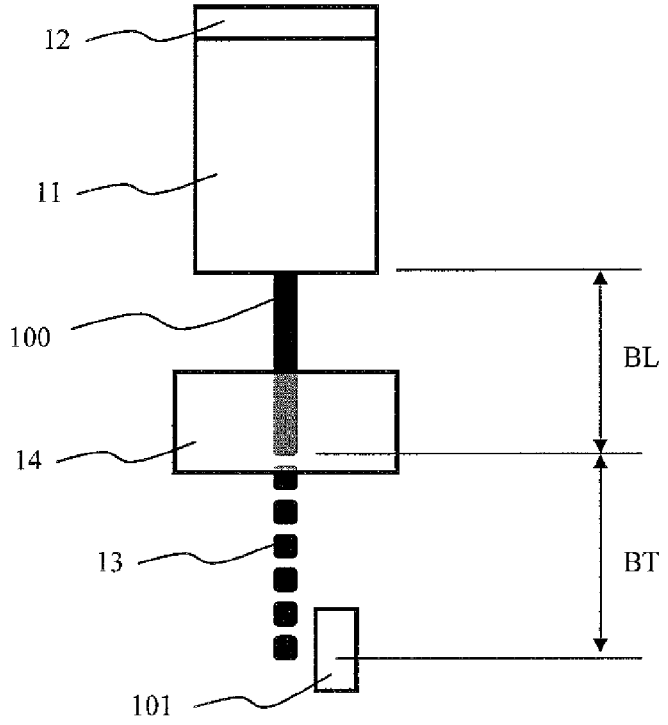
FIGS. 6A and 6B schematically depict changes in the break up length of a continuous stream of ink emanating from a nozzle of a print head of the continuous ink jet printer depicted in FIG. 1.

FIG. 6A schematically depicts a continuous stream of ink 100 emanating from the nozzle 11 of the print head (the print head being shown in FIG. 1). It can be seen that at a specific distance downstream from the nozzle 11, the continuous stream of ink 100 breaks up into drops 13. This point at which break up occurs is often referred to as the break up point, and the distance at which this break up point occurs from the nozzle 11 is known as the break up length BL. It can be seen that the break up point is located in the vicinity of the charge electrode 14, such that the charge electrode 14 can apply a charge to the continuous stream of ink 100 and to drops which emerge from the continuous stream of ink 100.

Figure 6B:
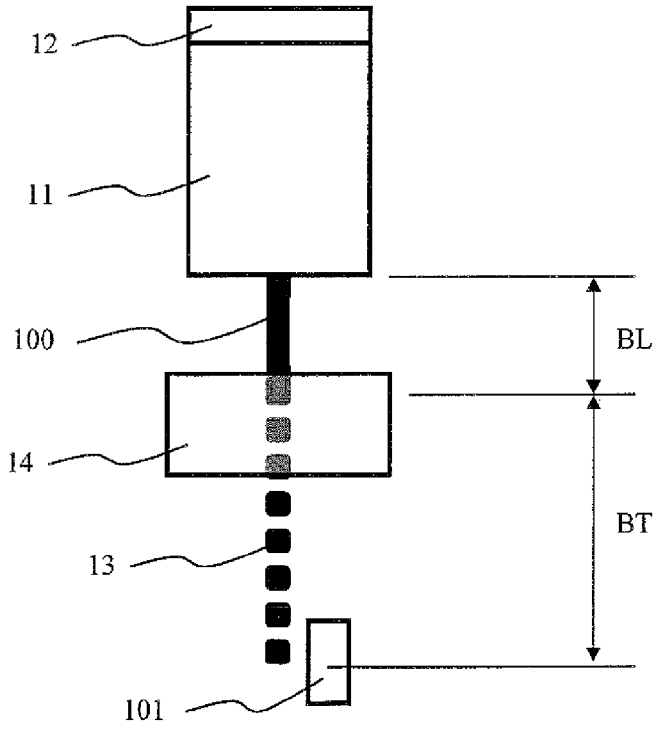

The break up length BL can be varied by varying the magnitude of the modulation voltage with which the piezoelectric oscillator 12 is driven. For example, in FIG. 6B the modulation voltage with which the piezoelectric oscillator 12 is driven has been varied. It can be seen that the break up length BL has also varied.

An absolute or relative determination of the break up length BL (or changes in the break up length BL) can be determined in a number of ways. As is known in the art, a phase detector 101 located downstream of the charge electrode 14 can be used to detect charged drops 13 which pass by it. Since the time at which the charge is applied to a drop can be determined, the time taken for the charge drop 13 to pass from the charge electrode 14 and past the phase detector 101 can be readily determined. The time taken for a charged drop 13 to pass the phase detector 101 after it has broken away from the continuous stream of ink 100 is sometimes referred to as the break up time BT. It can be seen from both FIG. 6A and FIG. 6B that as the break up time BT increases the break up length BL decreases. Conversely, as the break up length BL increases, the break up time BT decreases. It will therefore be appreciated that it is possible to determine, at least relatively, changes in the break up length BL from a measurement of the break up time BT. If the position of the charge electrode 14 relative to the nozzle 11 is known, as well as the distance between the charge electrode 14 and the phase detector 101, the absolute value of the break up length BL can be readily determined.

Figure 7:
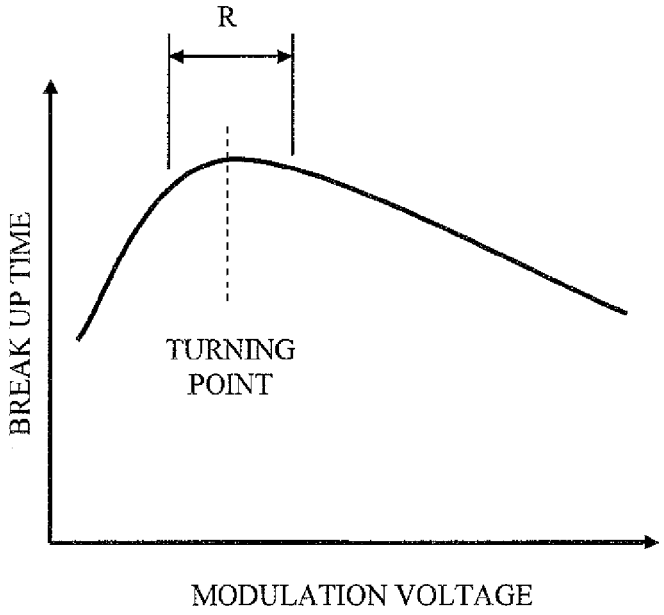
FIG. 7 is a graph schematically depicting the break up time of the continuous stream of ink depicted in FIG. 6A and 6B as a function of modulation voltage.

The relationship between the magnitude of the modulation voltage with which the piezoelectric oscillator 12 is driven and the break up length BL is not a directly proportional relationship. FIG. 7 is a graph schematically depicting the break up time (which is inversely proportional to the break up length BL) as a function of modulation voltage applied to the piezoelectric oscillator. It can be seen that as the modulation voltage is increased, the break up time, at first, steadily increases. In other words, the break up length steadily decreases, in that the break up point is moving towards the nozzle. At a specific modulation voltage, however, a turning point is reached. After this turning point, the break up time begins to decrease with increasing modulation voltage. In other words, the break up length increases with an increase in modulation voltage.

In the region around the turning point, the drops which emerge from the continuous stream of ink are regularly shaped and regularly spaced, and there are few, if any, satellite drops. Satellite drops are much smaller, and often irregularly shaped drops which can also emerge from the continuous stream of ink, but which can lead to a reduction in print quality. It is therefore desirable to ensure that the piezoelectric oscillator is driven with a modulation voltage which results in a break up time, or conversely a break up length, which is in the region of the turning point. The charge electrode of a continuous inkjet printer will often be located in the vicinity of or a turning point. It is, however, preferable to avoid the use of a modulation voltage which results in the break up length being equal to a turning point, since this is known to lead to instabilities in the generation of drops.

In prior art methods, it is known to determine a break up time (or length)—modulation voltage characteristic in order to determine a turning point. In use, the piezoelectric oscillator is then driven at a modulation voltage which results in a break up time or length either side of the identified turning point. This leads to the generation of regularly spaced and regularly shaped drops from the continuous stream of ink. A prior art continuous inkjet printer will therefore be set to drive the piezoelectric oscillator at this predetermined modulation voltage. This predetermined modulation voltage may vary for different ink-solvent mixtures, but nonetheless a constant and predetermined modulation voltage will be used to continuously drive the piezoelectric oscillator.

Figure 8A:
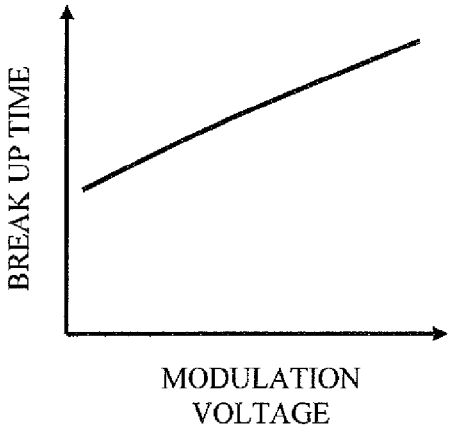
FIGS. 8A and 8B are graphs of other break up time-modulation voltage characteristics.
Figure 8B:
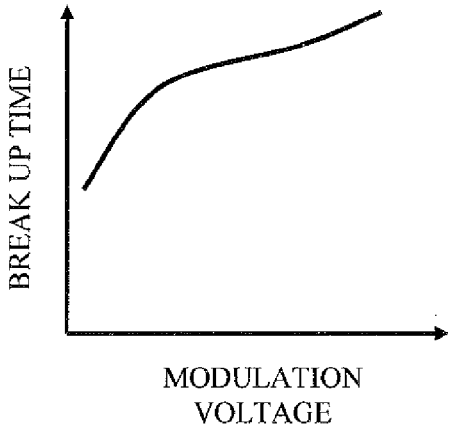

One problem with the prior art method, is that it relies on the fact that a turning point exists in the break up time (or length)-modulation voltage characteristic. This is not always the case. FIGS. 8A and 8B illustrate two different break up time-modulation voltage characteristics where there is no turning point in the voltage range used to derive the characteristics. There may be no turning point for one of a number reasons. For example, there may be no turning point due to the intrinsic structure of the ink-solvent mixture. In another example, there may be no turning point in the characteristic because the turning point exists below or above the modulation voltage range used to derive the characteristic. This range may be a range within (or in other words, over) which the piezoelectric oscillator 12 is drivable or operable. In another example, there may be no turning point (at all, or in the voltage range) due to environmental conditions, such as increases in temperature and humidity, etc which has led to the change in the properties of the ink-solvent mixture. In cases where a turning point cannot be identified, the prior art method is therefore not workable.

In accordance with another embodiment, the gradient of the break up time (or length)—modulation voltage characteristic (or any other characteristic related to movement of the break up point of the continuous stream of ink) is used to determine the magnitude of the modulation voltage that is to be used to drive the piezoelectric oscillator. That is, there is no requirement for the identification or use of a turning point in the characteristic.

Figure 9A:
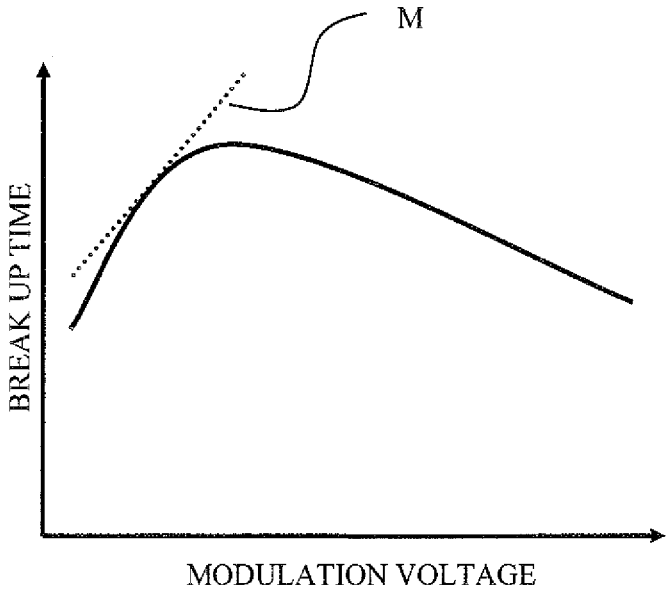
FIGS. 9A and 9B schematically depict operating principles of embodiments using different break up time-modulation voltage characteristics.

FIG. 9A is a graph schematically depicting a break up time-modulation voltage characteristic. A desired gradient M is illustrated relative to the graph. It can be seen that the desired gradient M coincides with at least a part of the characteristic, which in turn corresponds to at least one modulation voltage.

The gradient M may be desirable for a number of reasons. For example, the gradient may be associated with the uniform generation of regularly spaced and regularly shaped drops from the continuous stream of ink, with little or no satellite drops. The desired gradient M may be associated with other properties, for example the viscosity of the ink-solvent mixture, etc. The gradient M may be determined from empirical studies of an ink-solvent mixture or from theoretical modelling of the ink-solvent mixture.

Figure 9B:
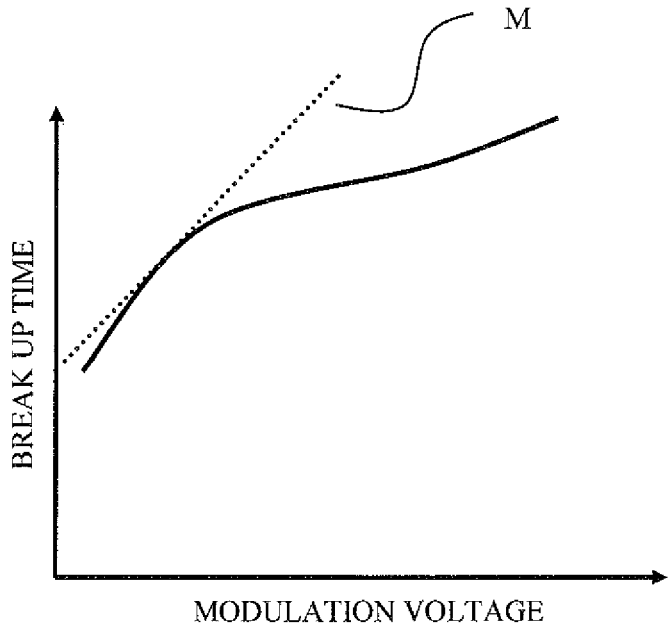

The pre-determination of the gradient M, and its subsequent identification in the break up time-modulation voltage characteristic is not dependent on the identification of any turning points in the characteristic. This principle is illustrated in FIG. 9B, which schematically depicts a break up time-modulation voltage characteristic which has no turning points in the range of modulation voltages used to derive the characteristic. It can be seen that a modulation voltage may be used to drive the piezoelectric oscillator which results in a point on the characteristic having the desired and predetermined gradient M. In contrast, the prior art method would not be workable with such a characteristic, since the characteristic exhibits no turning points.

If, for whatever reason, the predetermined and desired gradient is not present in the characteristic, a gradient related to that gradient can be used. For instance, temperature changes may result in a characteristic changing in shape, or shifting along the modulation voltage axis in FIG. 9A or 9B. Although the desired gradient may still be present in the characteristic, to achieve the desired gradient may require a modulation voltage which is outside of an operating voltage range of the arrangement controlling the piezoelectric oscillator, or the piezoelectric oscillator itself. In this case a gradient closest in magnitude to the predetermined and desired gradient, and which is achievable having regard to the modulation voltage, may be used.

Figure 10A:
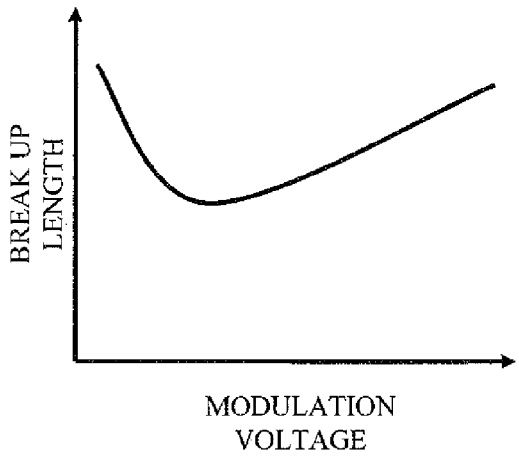
FIGS. 10A to 10C are graphs schematically depicting other characteristics which may be used in accordance with other embodiments.
Figure 10B:
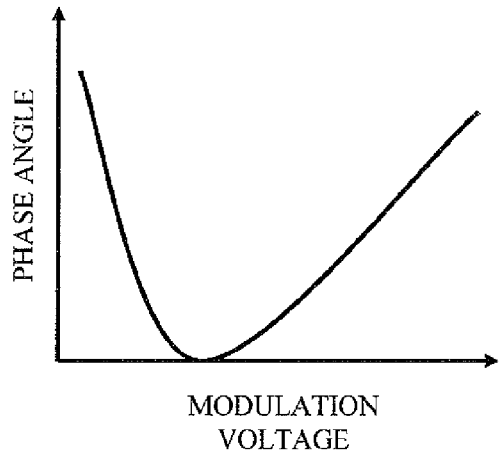

FIGS. 9A and 9B schematically depict break up time-modulation voltage characteristics. It will be appreciated that the characteristics do not need to be break up time-modulation voltage characteristics in order to take advantage of the described embodiments. Any characteristic which is indicative of movement of the break up point of the continuous stream of ink may be employed. For example, FIG. 10A shows a break up length-modulation voltage characteristic which may be employed. The desired gradient for this characteristic will be mathematically derivable from the gradient determined for the break up time-modulation voltage characteristic, and vice versa. In this particular Figure, the gradient for the break up length-modulation voltage characteristic will be the inverse of the break up-time modulation voltage characteristic. In another example, FIG. 10B is a graph schematically depicting a phase angle-modulation voltage characteristic. The phase angle-modulation voltage characteristic is another way of representing the break up length-modulation voltage characteristic. However, instead of representing the physical displacement of the break up point, the change in phase of the break up point relative to a charging signal applied to the charge electrode may be used to represent the displacement.

Figure 10C:
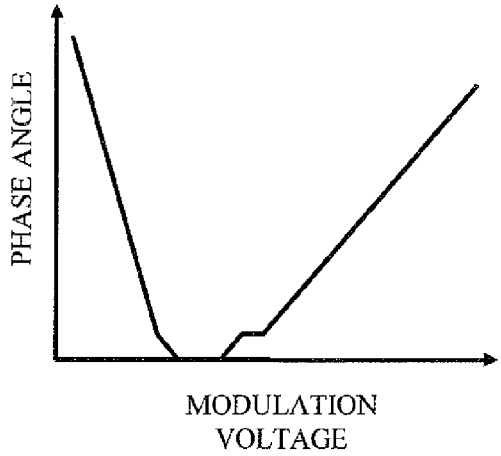

FIG. 10C shows that the characteristics used or determined may not be continuous, but can be discretised (e.g. formed from discrete lines, curves, gradients etc.). FIG. 10C shows a phase angle-modulation voltage characteristic which has been converted into a step-wise representation. In this case, it may be that the rate of change of steps in the characteristic is important. For example, it may well be that it is desired that the phase angle can change only by a certain amount over a given change in modulation voltage. It will be appreciated that, however, this is still a measure of the gradient of the characteristic (in other words, a rate of change of the phase angle with respect to modulation voltage).

In order to ensure that the selected modulation voltage results in a desired gradient, it may be necessary to determine a break up time (or break up length, phase angle change, etc)—modulation voltage characteristic during, for example, a testing phase, maintenance phase or period when the continuous inkjet printer is not printing (or at any other suitable time). The gradient of the characteristic can then be readily calculated, and an appropriate modulation voltage to achieve the predetermined gradient may be chosen. Once the appropriate modulation voltage has been determined, a driving arrangement can drive the piezoelectric oscillator at the appropriate modulation voltage. The process of determining the characteristic, and/or driving the piezoelectric oscillator at the required modulation voltage can be undertaken automatically by an arrangement (e.g. a determination and detections arrangement) connectable to the continuous inkjet printer, located within the inkjet printer, or located within the print head. For example, the arrangement may be or form part of the arrangement 21 shown in FIG. 1.

The desired gradient may be input to the arrangement in any one of a number of ways. For example, a user of the continuous inkjet printer may simply input the gradient via a control interface or the like. Alternatively, the desired gradient may be provided to the control electronics by interfacing the control electronics with a data storage medium which comprises information at least indicative of the desired gradient. For example, the ink or solvent cartridge 6 shown in FIG. 1 may be provided with a data storage medium which may be brought into communication with the continuous ink jet printer in order to provide it (or more specifically, the arrangement) with the desired gradient, as well as other information if desired.

Figure 11:
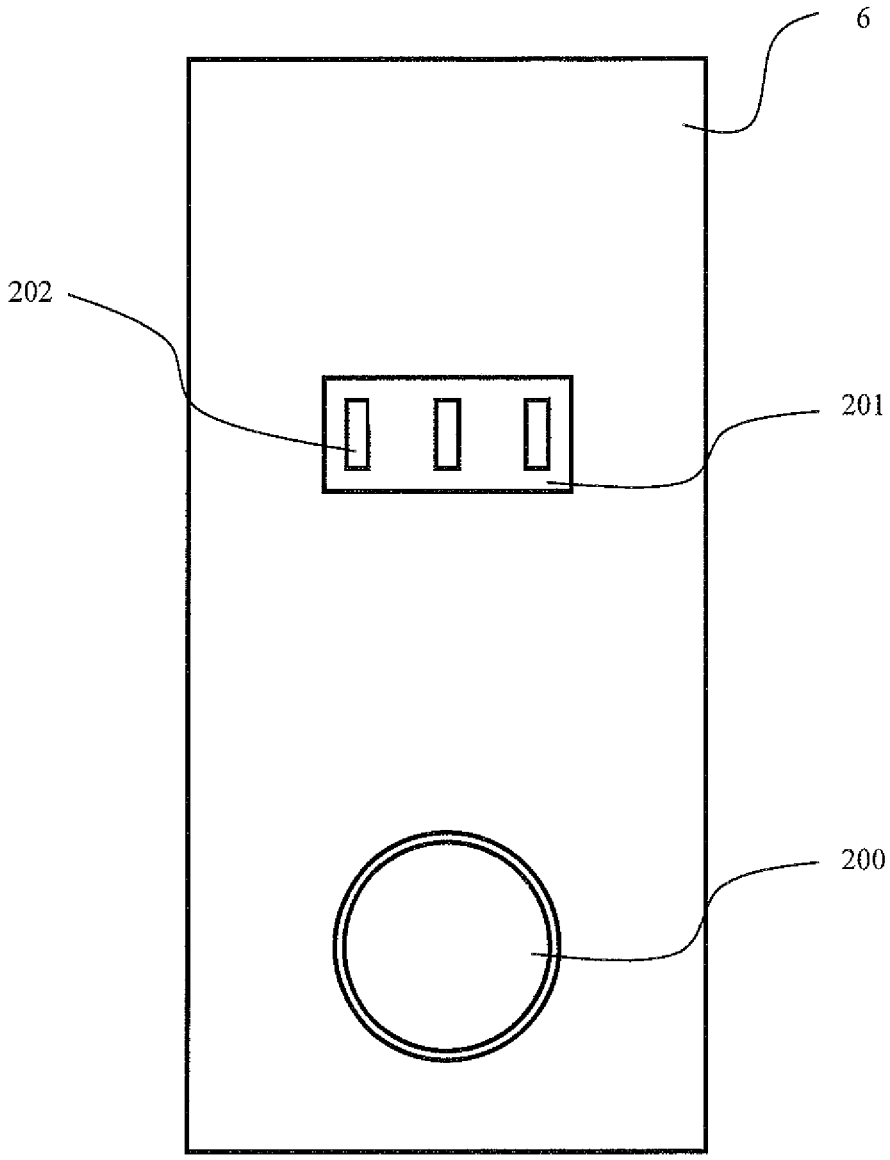
FIG. 11 is a front view of an ink cartridge provided with a data storage and transfer arrangement.

FIG. 11 shows the front face of an ink cartridge 6 provided with an aperture (may be a sealable aperture) 200 through which ink may flow from the cartridge 6 to the continuous ink jet printer. The cartridge 6 is also provided with a data storage medium 201. The data storage medium 201 may, amongst other things, contain information at least indicative of the desired gradient or gradients mentioned above. This information may be communicated to the ink jet printer by electrical contacts 202 which may be brought into contact with electrical contacts of the continuous ink jet printer (not shown). The information stored on the data storage medium 201 may be associated with the ink which the cartridge 6 contains. The data storage medium 201 may not simply store a single desired gradient. Instead, the data storage medium 201 may store a plurality of different desired gradients. Each of the desired gradients may be associated with a particular combination of factors, for example ambient temperature, viscosity of the ink, the amount of solvent mixed with the ink, etc. The continuous ink jet printer may be automatically configured to choose the correct desired gradient dependent on other information with which the printer is provided, for example, temperature information, viscosity information, ink-solvent composition information, etc.

While FIG. 11 depicted an ink cartridge 6 provided with a data storage medium 200, a solvent cartridge could also be provided with a similar or identical data storage medium 201, which may be arranged to store one or more desired gradients. It is not essential that the data storage arrangement 201 be located on, or form part of any cartridge. The data storage medium 201 may be any device, or be part of any device, which can communicate desired gradients to the printer, and more specifically to control electronics of the printer (in other words, the arrangement mentioned above). The communication may be undertaken through a wire, cable, electrical connection, etc, or be undertaken wirelessly. The device may be a part of the printer or print head, or engageable with the printer or print head.

It will be appreciated that the arrangement may be provided with the predetermined gradient, or a gradient related to that gradient. The arrangement may be configured to determine at least a part of the characteristic by, for example, varying the modulation voltage and measuring, or receiving information indicative of, a property indicative of the break up point of the continuous stream of ink. The arrangement may be able to determine the modulation voltage sufficient to achieve the desired gradient from the determined characteristic, or from a characteristic with which the arrangement is provided. The arrangement may be or comprise a driving arrangement. The arrangement may comprise a determination arrangement for determining the characteristic, and/or determining the modulation voltage sufficient to achieve the pre-determined or related gradient. The arrangement may comprise any suitable elements to determine the characteristic, and/or the modulation voltage sufficient to achieve the pre-determined or related gradient. Such elements may include: an oscilloscope; a signal generator; a computer; one or more programmed chips; an embedded processor. The arrangement may be part of any suitable apparatus. For example, the apparatus may be a control module, the print head, or, more generally, part of the continuous inkjet printer. For example, the arrangement may be located in the cabinet 3 of FIG. 1. The arrangement may form part of the control circuitry of the cabinet. The arrangement (or any other equipment or software) may be arranged to undertake the claimed method automatically.

Figure 12:
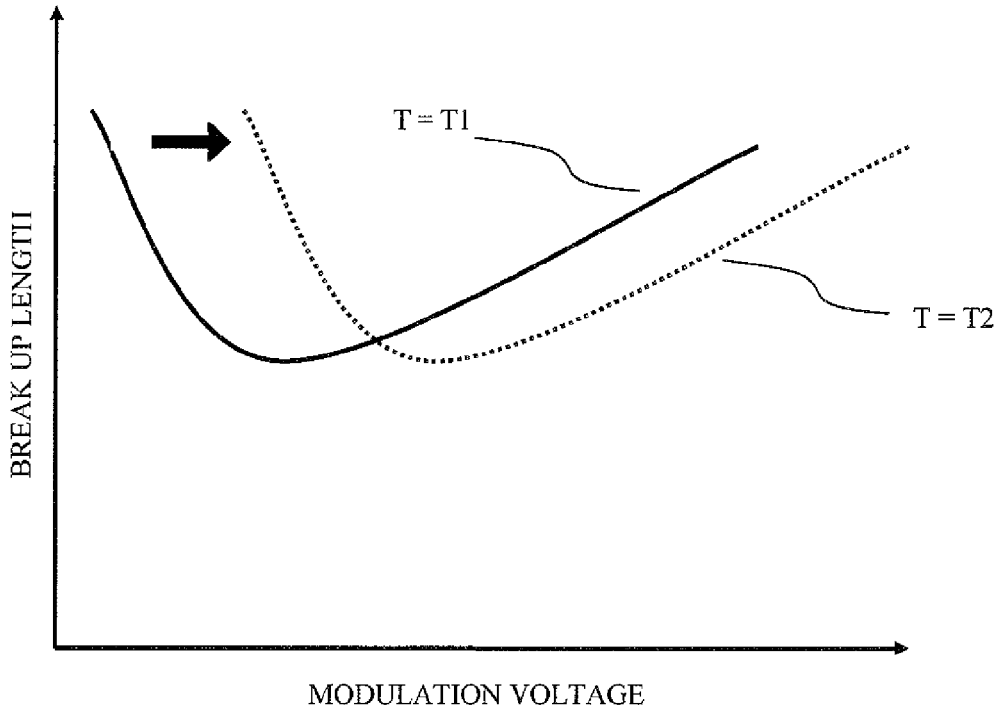
FIG. 12 is a graph schematically depicting a change in the break up length-modulation voltage characteristic as a function of temperature.

FIG. 12 schematically depicts two break up length-modulation voltage characteristics. Both of the characteristics are derived from the same ink (or ink-solvent mixture), used in the same continuous ink jet printer. The only difference between the characteristics is their temperature (or in other words, the temperature at which the characteristics were determined). It can be seen that the characteristics have the same general shape, but that their position along the modulation voltage axis is dependent upon the temperature. More specifically, it can be seen that at a temperature T=T1 the characteristic has a minimum, or turning point at a lower modulation voltage than the characteristic having a temperature T=T2. It can therefore be seen that as temperature is changed from T=T1 to T=T2, the characteristic for the ink (or ink-solvent mixture) has moved, and has shifted to the right in the graph depicted in the Figure.

In prior art methods and apparatus, a modulation voltage is chosen slightly offset from a modulation voltage which would result in a turning point in the characteristic. This chosen modulation voltage is then applied to the piezoelectric oscillator during operation of the printer, for example when the continuous ink jet printer is being used to print on to an object. In the prior art, the magnitude of the modulation voltage applied to the piezoelectric oscillator is not changed during operation of the printer.

It can be seen from FIG. 12 that if a constant modulation voltage is applied to the piezoelectric oscillator without taking into account, for example, temperature changes (or more generally, any change in the shape, position, or location of the characteristic) the break up length (or break up time, break up point phase angle, etc.) will vary, and may vary considerably. This may have a detrimental effect on the print quality. For example, it could well be that due to the change in temperature, and the corresponding movement of the characteristic, the modulation voltage no longer ensures that the break up length is in the region of a turning point, or even that the break up point of the continuous stream of ink is within or in the vicinity of the charge electrode.

In accordance with an embodiment of the present invention, problems in the prior art may be overcome by controlling one or more properties of the modulation voltage with which the piezoelectric oscillator is driven in order to take into account movement of the break up point of the continuous stream of ink. Furthermore, the property of the modulation voltage is controlled to ensure that in the characteristic of modulation voltage versus a property at least indicative of the break up point of the continuous stream of ink (for example, the break up point, break up length, break up time, or phase angle), the characteristic has a predetermined gradient, or a gradient related to this predetermined gradient, at the modulation voltage which the piezoelectric oscillator is driven at. That is, one or more properties of the modulation voltage are controlled to ensure that the gradient described above in relation to FIGS. 6-11 is, wherever possible, tracked as the characteristic moves or changes shape. This ensures that print quality is maintained regardless of changes in the characteristic which may be caused, for example, by temperature changes. The property can be, for example, the magnitude of the modulation voltage or the frequency of the modulation voltage.

Figure 13:
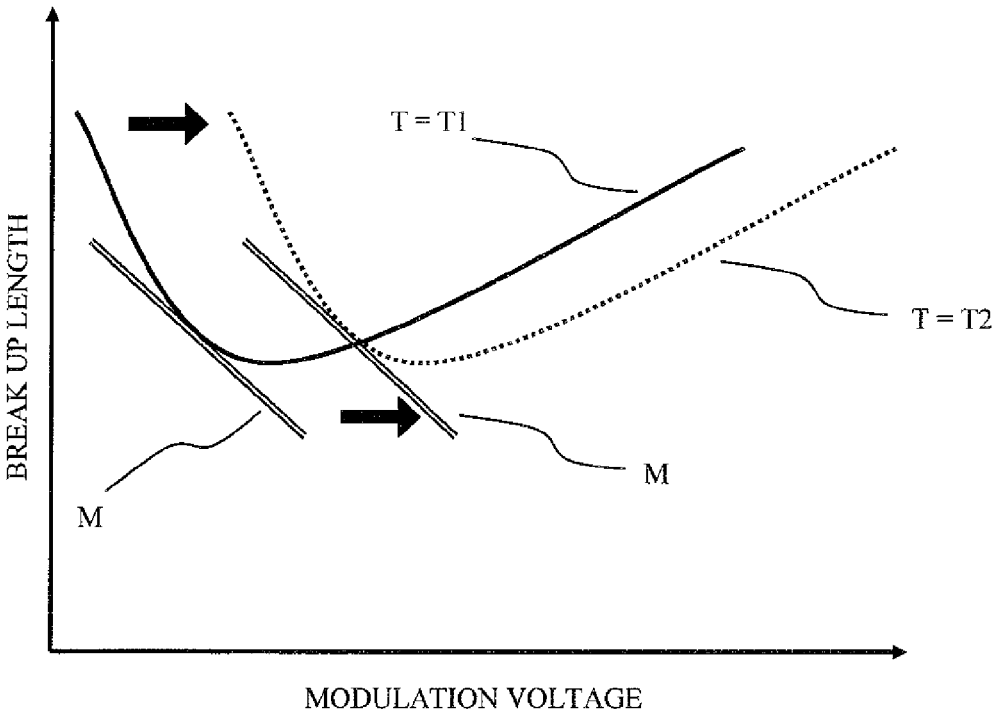
FIG. 13 schematically depicts operating principles of an embodiment using a graph schematically depicting a shift in the break up length-modulation voltage characteristic as a function of temperature.

FIG. 13 is a graph schematically depicting the same characteristics as shown in the graph of FIG. 12. A gradient M is shown relative to the characteristic determined at T=T1. At a later time, the temperature of the ink, for example, has increased, meaning that the characteristic has shifted to that represented by the characteristic T=T2. It can readily be seen that the gradient M is still present on the characteristic determined at T=T2. This means that the modulation voltage can be increased in magnitude to ensure that a point on the characteristic for T=T2 is reached where the gradient M is equal to the predetermined and desired gradient M (as discussed above in relation to previous Figures).

Although FIG. 13 shows a one-dimensional shift of the characteristic from T=T1 to T=T2 (i.e. along the modulation voltage axis), it will be appreciated that the principle of tracking the gradient is applicable to other more complex changes in the characteristic, or shift in the position of the characteristic. For example, if the characteristic shifts in two dimensions, or changes shape, the point at which the characteristic has the same gradient as the predetermined and desired gradient may be achieved by appropriate selection of the modulation voltage. The modulation voltage may need to be increased, or decreased depending on the change in the characteristic. In some instances, the modulation voltage may not need to be changed in order to achieve the predetermined gradient on the changed characteristic.

It has already been described how a predetermined gradient in a characteristic may be achieved by variation of the modulation voltage. The tracking of this gradient may be achieved in much the same way. For example, if the characteristic changes shape or position, the modulation voltage can be varied until a point on the changed characteristic is determined which has the same gradient as the predetermined and desired gradient. An arrangement can be provided, as mentioned above, which can vary the modulation voltage and detect changes in properties at least indicative of movement of the break up point, in order to establish a new characteristic and determine its gradient and at which point a modulation voltage is sufficient enough to achieve the predetermined and desired gradient. Alternatively, an arrangement may be able to use predetermined characteristics (for example, at different temperatures and for different inks etc) and look-up the required modulation voltage to achieve the predetermined and desired gradient. The arrangement can also be configured to communicate with, or receive information from a data storage medium, as mentioned above.

The method of controlling a property of the modulation voltage to take into account movement of the break up point of the continuous stream of ink, and tracking the predetermined gradient or a related gradient, may have any of the features of others embodiments described herein, and in particular those embodiments described above which relate to the gradient of a characteristic and how the modulation voltage may be chosen to ensure that the gradient is equal to a predetermined (or related) gradient.

Tracking of the modulation voltage may be undertaken between the printing of characters or images on to an object, or after a batch of images or characters has been printed. Alternatively, the tracking (or in other words auto-calibration) may be undertaken during maintenance stages, or periodically throughout the operation of the printer. The tracking method may be undertaken each time the printer is turned on, when it is moved from one location to another, or when, for example, the temperature is deemed to have changed by an amount which may have an impact on the print quality.

Figure 14:
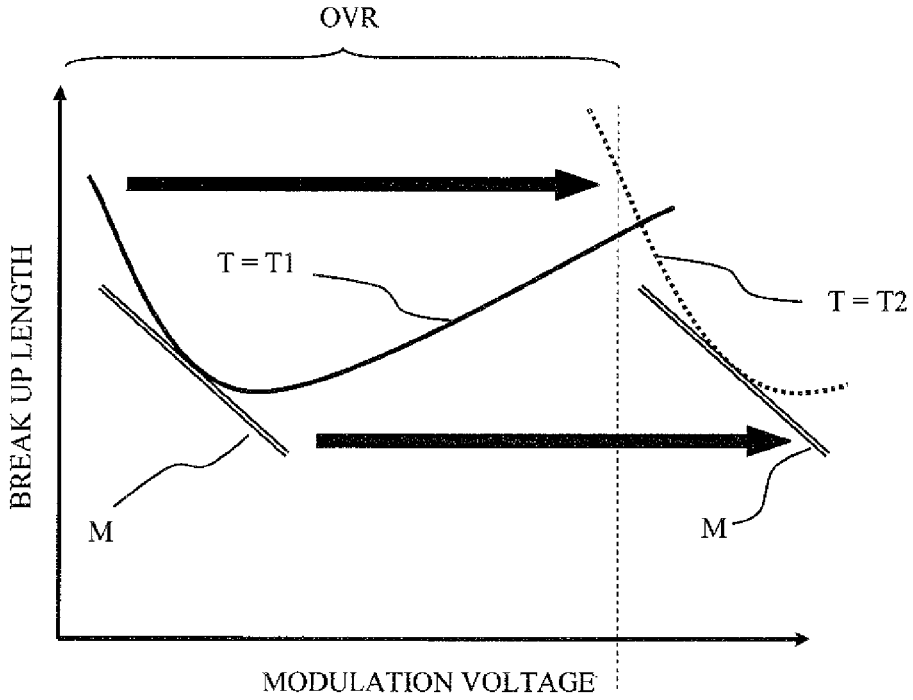
FIG. 14 is a graph schematically depicting a shift in the break up length-modulation voltage characteristic as a function of temperature, relative to an operating voltage range.
Figure 15:
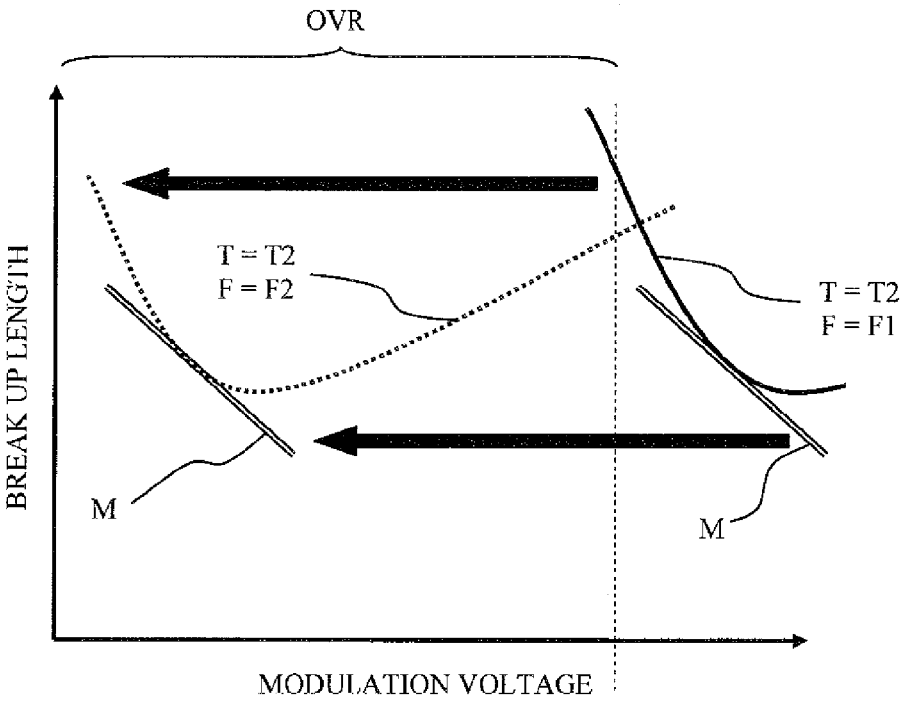
FIG. 15 is a graph schematically depicting a break up length-modulation voltage characteristic which has been shifted substantially outside of an operating voltage range, and how this characteristic may be shifted back into the operating voltage range.

FIG. 14 shows a characteristic taken at a first temperature T=T1 and a characteristic determined at a second temperature T=T2. It can be seen that the characteristic has shifted as the temperature has varied from T=T1 to T=T2. Similarly, it can be seen that the characteristic at T=T2 has at least one point with the same gradient M as is present in the characteristic taken at T=T1 (i.e. the predetermined and desired gradient). However, the gradient M which is present in the characteristic of T=T2 corresponds to a modulation voltage which is outside an operating voltage range OVR. This operating voltage range OVR may be an operating voltage range of any part of the continuous ink jet printer, for example an element of the print head such as the piezoelectric oscillator. This means that although, in theory, a modulation voltage could be used which would result in a gradient equal to the predetermined desired gradient M, in practice it may not possible to achieve this gradient. FIG. 15 shows how this problem may be overcome.

In FIG. 15, the characteristic at the second temperature T=T2 is shown. This characteristic is determined at a first modulation frequency F=F1. By varying the modulation frequency to F=F2, the characteristic at T=T2 can be shifted back into the operating voltage range OVR. The predetermined and desired gradient M can then be tracked as described above. It may well be that the frequency has to be increased, or decreased in order to shift the characteristic back into the operating voltage range. In some cases, it may not be necessary to shift the characteristic, and it may therefore not be necessary to change the modulation frequency at which the piezoelectric oscillator is driven.

If, for whatever reason, the predetermined and desired gradient is not present in the characteristic (even when shifted), a gradient related to that gradient can be used. For instance, temperature changes may result in a characteristic changing in shape, or shifting along the modulation voltage axis in FIGS. 12 to 15. Although the desired gradient may still be present in the characteristic, to achieve the desired gradient may require a modulation voltage which is outside of an operating voltage range of the arrangement controlling the piezoelectric oscillator, or the piezoelectric oscillator itself (or other part of the continuous inkjet printer). In this case a gradient closest in magnitude to the predetermined and desired gradient, and which is achievable having regard to the modulation voltage, may be used. Instead of shifting the desired gradient of the characteristic into an operating voltage range by changing the modulation frequency, a closest gradient in magnitude to the predetermined gradient may be used. That is, a closest gradient in magnitude to the predetermined gradient may be used instead of having to shift (or more generally speaking, change the shape or position of) the characteristic.

The method of controlling at least one property of the modulation voltage to take into account movement of the break up-point of the continuous stream of ink may be undertaken using any suitable apparatus, for example the arrangement mentioned above. The method may be undertaken automatically.

The method of tracking the gradient, or the method for ensuring that a pre-determined gradient on a characteristic is achieved, may, at least in part, be iterative. For instance, the method may comprise: determining a gradient of the (determined or received) characteristic at a modulation voltage with which the electromechanical converter is driven; comparing the magnitude of the determined gradient with the magnitude of the predetermined gradient, or the gradient related to the predetermined gradient; and controlling a property of the modulation voltage to bring the magnitude of the determined gradient closer to the magnitude of the predetermined gradient, or the gradient related to the predetermined gradient. This process may be undertaken one or more times.

As described above, it may be preferable to avoid the use of a modulation voltage which results in the break up length being equal to a turning point, since this is known to lead to instabilities in the generation of drops. It may therefore be desirable to ensure that, in a characteristic of modulation voltage versus a property at least indicative of a break up point of the continuous stream of ink, the characteristic has a predetermined (i.e. pre-selected) gradient, or a gradient related to this predetermined (i.e. pre-selected) gradient which is non-zero (i.e. which does not coincide with a turning point in the characteristic).

All of the methods described above may be undertaken automatically. That is, the continuous ink jet printer can be configured to drive the piezoelectric oscillator at its natural and unmodified resonant frequency (or slightly offset therefrom), the magnitude of the modulation voltage used being chosen to result in a predetermined gradient in a break up time (or break up length, phase angle, etc)—modulation voltage characteristic without any input from a user. This means that the modulation voltage applied to the piezoelectric oscillator (or other electro mechanical converter) may be auto-calibrated to take into account changes in environmental conditions, or ageing of the oscillator (or other equipment) etc. This means that little or no time is required by a user of the continuous ink jet printer to calibrate the piezoelectric oscillator or its driving modulation voltage. Since all of the methods according to the described embodiments can be undertaken automatically, costs and down-time may be reduced.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "may", "may be", "preferable", "may be", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A method of driving an electromechanical converter of a print head of a continuous inkjet printer, the electromechanical converter being arranged to break up a continuous stream of ink into a plurality of drops, the method comprising:

providing an ink that does not have a turning point in a characteristic of a gradient of a property at least indicative of a break up point of the continuous stream of the ink versus a modulation voltage;

determining a characteristic of a gradient of a property at least indicative of a break up point of the continuous stream of the ink versus a modulation voltage;

determining a modulation voltage to drive the electromechanical converter, a property of the modulation voltage being controlled to take into account movement of a break up point of the continuous stream of the ink, and to ensure that in the characteristic of the gradient of a property at least indicative of the break up point of the continuous stream of the ink versus the modulation voltage has a predetermined non-zero value, wherein the property at least indicative of the break up point of the continuous stream of the ink is one of a group comprising: a break up point; a break up length; a break up time; and a phase angle between a break up point and a signal used to give drops of the ink a charge; and driving the electromechanical converter at the determined modulation voltage, wherein the method is not dependent on the identification of a turning point in the characteristic of a gradient of a property at least indicative of a break up point of the continuous stream of the ink versus a modulation voltage.

2. The method of claim 1, wherein the property of the modulation voltage is the magnitude of the modulation voltage.

3. The method of claim 1, wherein the property of the modulation voltage is the frequency of the modulation voltage.

4. The method of claim 1, wherein, when a modulation voltage which is sufficient to ensure that the characteristic has the predetermined gradient cannot be used, changing the frequency of the modulation voltage so that a modulation voltage can be used which results in a gradient on the characteristic which is equal to the predetermined gradient.

5. The method of claim 1, wherein, when a modulation voltage which is sufficient to ensure that the characteristic has the predetermined gradient is outside of an operating voltage range, changing the frequency of the modulation voltage so that a modulation voltage can be used which is within the operating voltage range, and which results in a gradient on the characteristic which is equal to the predetermined gradient.

6. The method of claim 5, wherein the operating voltage range is an operating voltage range of the electromechanical converter.

7. The method of claim 1 wherein, if the property of the modulation voltage cannot be controlled to ensure that, in the characteristic of modulation voltage versus the property at least indicative of the break up point of the continuous stream of ink, the characteristic has the predetermined gradient, controlling the property of the modulation voltage to ensure that in the characteristic of modulation voltage versus the property at least indicative of the break up point of the continuous stream of ink, the characteristic has a gradient related to the predetermined gradient.

8. The method of claim 7, wherein the related gradient is the closest gradient in magnitude to the predetermined gradient.

9. The method of claim 1, comprising using an already obtained characteristic to determine the property of the modulation voltage, or a magnitude of the property of the modulation voltage.

10. The method of claim 1, comprising determining at least a part of the characteristic in order to determine the property of the modulation voltage, or a magnitude of the property of the modulation voltage.

11. The method of claim 1, comprising:

determining a gradient of the characteristic at a modulation voltage with which the electromechanical converter is driven;

comparing the magnitude of the determined gradient with the magnitude of the predetermined gradient, or the gradient related to the predetermined gradient; and controlling a property of the modulation voltage to bring the magnitude of the determined gradient closer to the magnitude of the predetermined gradient, or the gradient related to the predetermined gradient.

12. The method of claim 11, comprising providing the arrangement with information at least indicative of the characteristic.

13. The method of claim 1, wherein the method is undertaken by an arrangement comprising:

a driving arrangement configured to drive the electromechanical converter at the determined modulation voltage.

14. The method of claim 13, comprising providing the arrangement with information at least indicative of the predetermined gradient.

15. The method of claim 13, the arrangement determining at least a part of the characteristic.

16. The method of claim 1, wherein the method is undertaken automatically.

17. The method of claim 1, wherein the predetermined gradient, or a gradient related to this predetermined gradient, is at least indicative of properties of the ink which forms the continuous stream of ink.

18. A method of driving an electromechanical converter of a print head of a continuous inkjet printer, the electromechanical converter being arranged to break up a continuous stream of ink into a plurality of drops, the method comprising:

providing an ink that does not have a turning point in a gradient of a break up point of the continuous stream of the ink versus a modulation voltage;

determining a gradient of a break up point of the continuous stream of the ink versus a modulation voltage;

determining a modulation voltage to drive the electromechanical converter by ensuring that the gradient of the break up point of the continuous stream of the ink versus the modulation voltage has a predetermined value, wherein the predetermined value is non-zero; and driving the electromechanical converter at the determined modulation voltage, wherein the method is not dependent on the identification of a turning point in a gradient of a break up point of the continuous stream of the ink versus a modulation voltage.

19. The method of claim 1 wherein the characteristic of a gradient of a property at least indicative of a break up point of the continuous stream of ink versus a modulation voltage has no turning point.

20. The method of claim 18 wherein the gradient of a break up point of the continuous stream of ink versus a modulation voltage has no turning point.

* * * * *